US007094042B1

(12) United States Patent
Borgetti et al.

(10) Patent No.: US 7,094,042 B1
(45) Date of Patent: Aug. 22, 2006

(54) DUAL-INLET GEAR PUMP WITH UNEQUAL FLOW CAPABILITY

(75) Inventors: David W. Borgetti, Rockford, IL (US); Timothy P. Walgren, Powers Lake, WI (US); Christian L. Griffiths, Rockford, IL (US)

(73) Assignee: Hamilton Sundstrand Corporation, Rockford, IL (US)

( * ) Notice: Subject to any disclaimer, the term of this patent is extended or adjusted under 35 U.S.C. 154(b) by 274 days.

(21) Appl. No.: 10/816,397

(22) Filed: Apr. 1, 2004

(51) Int. Cl.
*F03C 2/00* (2006.01)
*F04C 2/00* (2006.01)

(52) U.S. Cl. ..... 418/15; 418/206.1; 418/206.4

(58) Field of Classification Search ..... 418/15, 418/206.4, 206.8, 206.1
See application file for complete search history.

(56) References Cited

U.S. PATENT DOCUMENTS

| | | | | |
|---|---|---|---|---|
| 1,902,346 | A * | 3/1933 | Vogt | 418/15 |
| 2,301,496 | A * | 11/1942 | Aldrich | 417/310 |
| 3,018,641 | A * | 1/1962 | Carpigiani | 418/15 |
| 3,045,778 | A * | 7/1962 | Mosbacher | 418/15 |
| 3,182,596 | A | 5/1965 | Prijetel | |
| 3,420,180 | A | 1/1969 | Schmitt | |
| 3,435,773 | A | 4/1969 | Gustafsson | |
| 3,824,041 | A | 7/1974 | Rystrom | |
| 4,631,009 | A | 12/1986 | Cygnor | |
| 5,004,407 | A | 4/1991 | Hutchison | |
| 5,071,328 | A | 12/1991 | Schlictig | |
| 5,586,875 | A | 12/1996 | Ondrejko | |
| 6,135,741 | A | 10/2000 | Oehman, Jr. | |
| 6,138,646 | A | 10/2000 | Hansen | |
| 6,223,775 | B1 | 5/2001 | Hansen | |
| 6,241,498 | B1 | 6/2001 | Hansen | |
| 6,705,847 | B1 * | 3/2004 | Sagawe et al. | 418/15 |
| 2002/0061256 | A1 | 5/2002 | Hansen | |

* cited by examiner

*Primary Examiner*—Theresa Trieu
(74) *Attorney, Agent, or Firm*—Carlson, Gaskey & Olds

(57) ABSTRACT

A dual-inlet gear pump includes a drive gear and a driven gear. The invention utilizes the discovery that the drive gear will typically move a higher flow volume than does the driven gear, particularly when the fluid being moved is an air/oil mixture. The present invention takes advantage of this discovery to communicate a first higher expected flow source to the drive gear, and to separately communicate a second, relatively lower expected flow rate to the driven gear. A particular application is in a scavenging pump for a jet engine.

10 Claims, 3 Drawing Sheets

DUAL-INLET GEAR PUMP WITH UNEQUAL FLOW CAPABILITY

BACKGROUND OF THE INVENTION

This invention relates to a dual-inlet gear pump wherein a drive gear is configured to receive a higher flow volume than its associated driven gear. The invention has particular application in scavenging elements that pump an air/oil mixture from an oil sump in a jet engine, or from airframe or engine mounted gearboxes.

Jet engines, such as utilized in aircraft, include a lubrication system having an oil pump for moving lubricant from an oil tank to several components associated with the jet engine. In particular, oil is delivered to gear sets utilized to take power from the jet engine and drive various accessory functions. In addition, oil is delivered to bearings for the rotating components of the jet engines, which may include gearboxes.

Typically a scavenging pump is included to return the oil back to the tank from these several components. The scavenged oil is typically mixed with air when moved by the scavenging pump away from the component.

Gear pumps are one pumping mechanism utilized as the scavenging pumps. A dual-inlet gear pump as has been utilized in this application, has included separate inlets for delivering the air/oil mixture to two rotating gears, with a common discharge. The dual-inlet gear pump typically includes a gear rotated by a gearbox-driven input drive shaft, such as from the jet engine power plant. This first gear is known as the drive gear since it engages and drives a second, or driven gear. This known scavenging pump was utilized in an application where each gear received the same supply of fluid volume.

The jet engine environment is one where space is at a premium. Thus, it would be desirable to have the scavenging pump be as small as possible, and to operate as efficiently as possible such that its size may be reduced.

Dual-inlet gear pumps are known wherein separate inlets deliver fluid to the drive and driven gears. However, these prior art gear pumps are not associated with the scavenging pump on a jet engine, nor have they been utilized as efficiently as may be desired.

SUMMARY OF THE INVENTION

A main feature of this invention is the inventors' discovery that in a dual-inlet gear pump, and in particular for one moving an air/oil mixture, the drive gear is able to move a higher volume of fluid than is the driven gear. This is true since residual air is trapped in a gear root, and expands to partially fill a tooth space on the driven gear as the gears rotate out of contact and toward a lower pressure inlet window in a pump housing. This gear tooth space volume is thus partially filled with carry-over air, and does not accept a full tooth space of new air/oil mixture from the inlet.

As a first embodiment of this invention, a method is disclosed for utilizing a dual-inlet gear pump that associates a first inlet for the drive gear with a higher volume flow and a second inlet for a driven gear with a lower volume flow. In disclosed embodiments and applications, the dual-inlet gear pump is utilized as a scavenging pump for a dry sump lubrication system in a jet engine. However, a dual-inlet gear pump having the higher volume flow directed to the inlet for the drive gear, and a lower volume flow directed to the inlet for the driven gear, would come within the scope of this invention, regardless of the particular application.

These and other features of the present invention can be best understood from the following specification and drawings, the following of which is a brief description.

DETAILED DESCRIPTION OF THE PREFERRED EMBODIMENT

Figure 1:
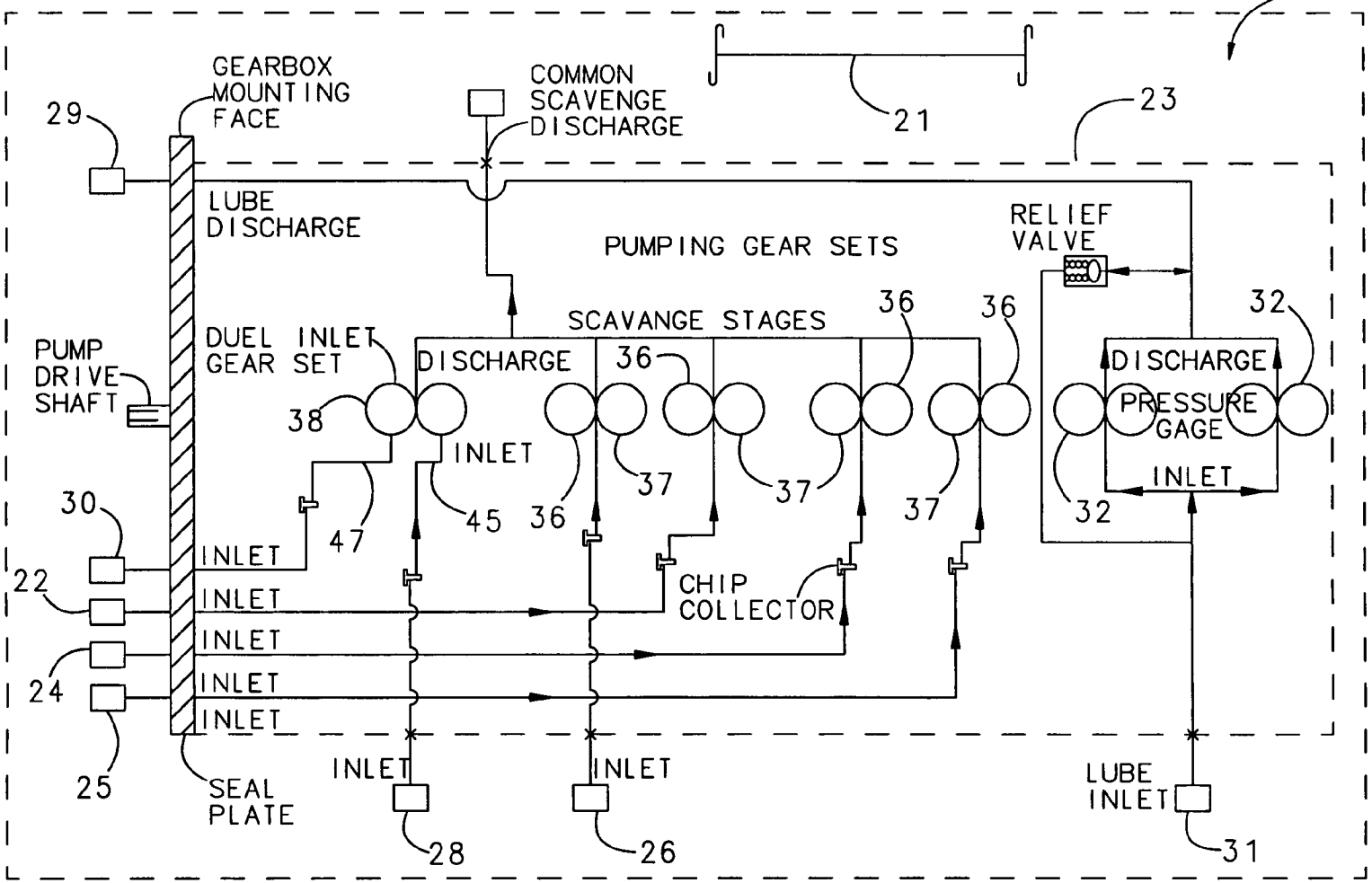
FIG. 1 is a schematic view of the inventive dual-inlet gear pump incorporated into a jet engine.

A jet engine 20 is illustrated schematically in FIG. 1. As shown, a drive shaft 21 of the jet engine is powered by combustion, and driven to rotate. A main gearbox 30 takes this rotation and powers accessory components. Among the accessory components are an oil lubrication and scavenging pump 23 that delivers oil to and from gearbox 30 and its accessory components. Oil lubrication and scavenging pump 23 also delivers oil to and from bearings 22, 24, 25 and 26 for supporting the drive shaft 21, or other shafts. The main gearbox 30 drives an angled gearbox 28. Notably, the oil lubrication and scavenging pump's features (gear sets) and other accessory components are illustrated schematically. There may be a larger number of such components.

Oil is delivered by the lube oil pump 32 from an oil tank 31 to the engine and gearbox components. A scavenging pump 36 includes a number of separate gear sets 37, which may receive a single inlet flow (here from components 22, 24, 25, 26). Further, a gear set 38 receives flow from two of the components 28 and 30, as illustrated schematically. As known, scavenging pump 36 applies a suction to the several components, and pulls oil from the components along with entrapped air. Thus, the fluid actually moved by the gear sets 37 and 38 includes a good deal of air mixed with oil.

Figure 2:
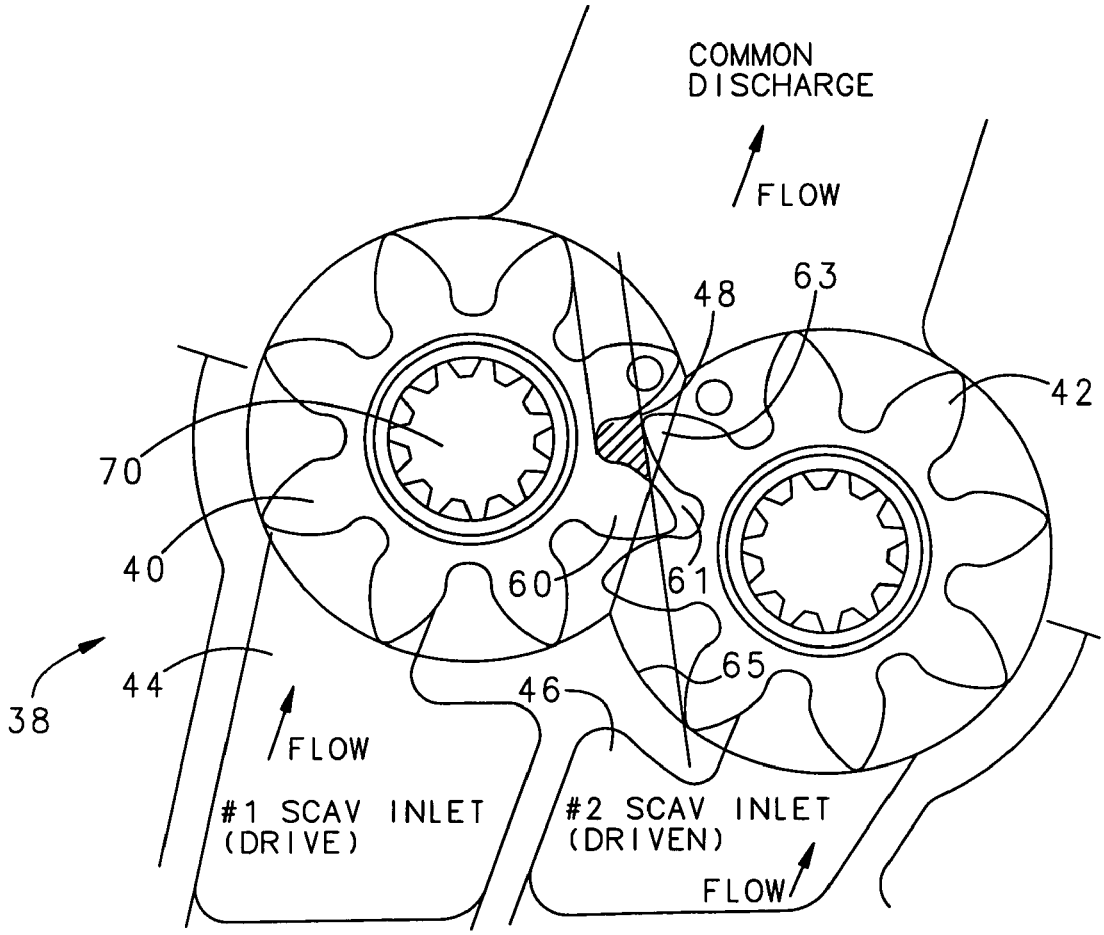
FIG. 2 is a cross-sectional schematic view through the inventive dual-inlet gear pump.

As shown in FIG. 2, the present invention utilizes a discovered operational feature of a dual-inlet gear set to provide more efficient operation. As is known, of the two gears in the gear set 38, drive gear 40 is driven, such as by a take-off power from the drive shaft 21. The drive gear 40 engages and drives the driven gear 42.

As shown in FIG. 2, the present invention provides a first scavenge inlet 44 for the drive gear 40 and a separate scavenge inlet 46 for the driven gear 42. As can be appreciated from FIG. 1, these two drive inlets communicate with two separate components 28 and 30.

As also shown in FIG. 2, a shaft 70 drives drive gear 40, which in turn engages and drives driven gear 42. As mentioned above, the shaft 70 may be driven by the shaft 21 from the jet engine. Also, ports 45 and 47 communicate the inlets 44 and 46, respectively, into the pump chambers for the drive and driven gears.

As mentioned above, an inter-tooth volume trapped air 48 can re-expand as the teeth move out of engagement, and be trapped in a tooth gap on the driven gear 42. As the gears 40 and 42 continue to rotate, the teeth 60 and 63 on the gears 40 and 42, respectively, tend to move out of engagement. As this occurs, the air from space 48 moves into the tooth root space 61 on the driven gear 42. This air is trapped and continues to rotate with the driven gear 42 until it seals on a face or surface 65 approaching the inlet 46. As tooth root space 61 approaches inlet 46, the entrapped air fills a portion of the volume, preventing the driven gear 42 from carrying as much fluid as it otherwise would be capable of providing. Notably, it is believed for this phenomenon to occur, the length of the surface 65 must be greater than the inter-tooth distance on the driven gear 42 such that the teeth seal on the surface 65, entrapping air in the space 61. It has been found that the overall capacity for fluid moved by the driven gear 42 is less than that of the drive gear 40. It is believed this is largely due to the entrapped air in the tooth space 48. In tests, there appears to be a difference in flow volumes on the order of 10–15%.

The present invention utilizes this recognition to attach the inlet 44 to the component 28, and attach the inlet 46 to a component 30, wherein the component 30 has a lower expected flow rate than component 28. In this manner, the two gears 40 and 42 more efficiently move the fluid from the components 28 and 30.

Figure 3:
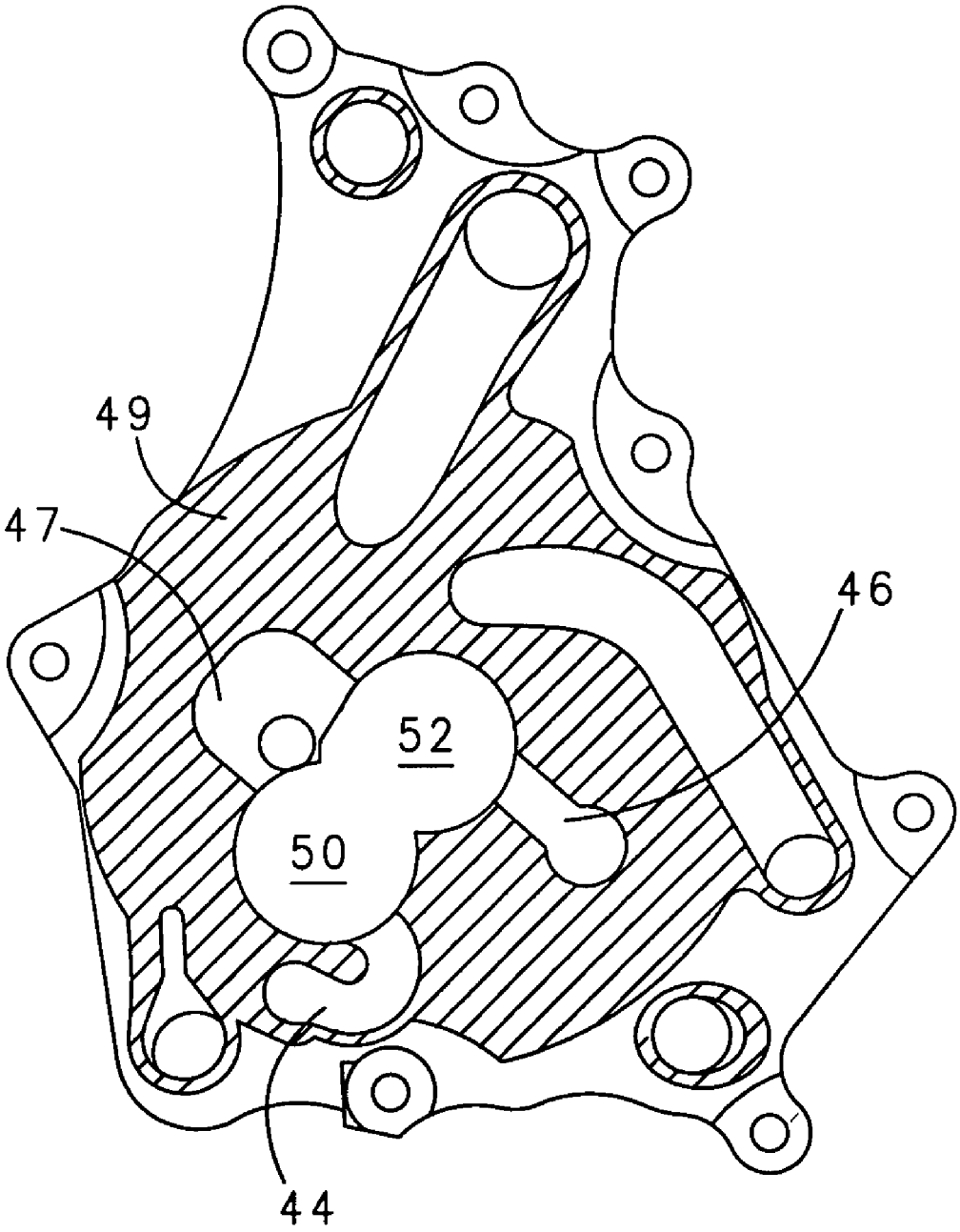
FIG. 3 is a cross-sectional end view of the housing for receiving the dual-inlet gear pump.

As shown in FIG. 3, a housing 49 incorporates gear chambers 50 and 52 for receiving the drive gear 40 and driven gear 42. Housing 49 also includes the associated inlets 44 and 46 as explained above.

The present invention thus better utilizes a dual-inlet gear pump to more efficiently move a fluid from two distinct locations, wherein the two locations do not have equal flow needs. While the present invention is particularly useful, and is disclosed in a scavenging pump for a jet engine, other applications for a dual-inlet gear pump where there are two distinct flows will benefit from this invention.

While the application is specifically disclosed being utilized to move a fluid from gearboxes for a jet engine, scavenging pumps for other gearboxes can benefit from this invention. In particular, airframe-mounted gearboxes associated with an aircraft, but not part of the jet engine, may also have particular application for this invention. Of course, other applications, such as bearings, may utilize the inventive arrangement.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A dual-inlet gear pump comprising:

a drive gear associated with a drive shaft to be driven, said drive gear having gear teeth engaging gear teeth on a second driven gear;

a first inlet for delivering a fluid to be pumped to said drive gear, and a second inlet, separate from said first inlet, for delivering a fluid to be pumped to said driven gear, said first inlet to be communicated to a first source of fluid, and said second inlet to be communicated to a second source of fluid, said first source of fluid having a higher flow rate than said second source; and said first source of fluid being delivered to an inlet of said drive gear through said first inlet, and said second source of fluid being delivered to an inlet of said driven gear through said second inlet.

2. A dual-inlet gear pump as set forth in claim 1, wherein the dual-inlet gear pump is part of an oil scavenging system for a jet engine, and said first and second sources of fluid provide an air/oil mixture to said first and second inlets.

3. A dual-inlet gear pump as set forth in claim 1, wherein consecutive teeth of said driven gear sealing on a housing surface as said teeth approach a port for communicating with said second inlet, said surface being sufficiently long such that adjacent ones of said teeth seal on said surface for at least a period of time as they approach said port.

4. A dual-inlet gear pump as set forth in claim 1, wherein said dual-inlet gear pump is part of an oil scavenging system for a gearbox, and said first and second sources of fluid provide an air/oil mixture to said first and second inlets from distinct gearbox locations.

5. A dual-inlet gear pump as set forth in claim 4, wherein said distinct gearbox locations are two distinct gearboxes.

6. A method of providing a gear pump comprising the steps of:

(1) providing a drive gear attached to a source of drive, said drive gear being provided with teeth at an outer periphery, said teeth on said drive gear engaging mating teeth on a driven gear such that rotation of said drive gear causes rotation of said driven gear;

(2) providing a first inlet for providing a fluid to said drive gear and a separate second inlet for providing a fluid to said driven gear;

(3) connecting said first and second inlets to a first and second source of fluid, respectively, said first source of fluid having a higher flow rate than said second source of fluid; and (4) delivering said first and second sources of fluid directly to an inlet of a respective one of said drive and driven gears.

7. A method as set forth in claim 6, wherein said first and second sources of fluid are components on a jet engine.

8. A method as set forth in claim 6, wherein said first and second sources of fluid deliver an air/oil mixture.

9. A lubricant scavenging system for a jet engine comprising:

a dual-inlet gear pump including a drive gear being driven to rotate by a jet engine drive, said drive gear having teeth at an outer periphery engaging teeth on a driven gear such that rotation of said drive gear causes rotation of said driven gear;

a first fluid supply communicating with a first component on the jet engine and a second fluid supply communicating with a second component on the jet engine;

a first inlet communicating said first fluid supply to said drive gear and a second inlet communicating said second fluid supply to said driven gear, said first and second inlets being separate from each other, and said first component having a higher flow rate than said second component; and said first source of fluid being delivered to an inlet of said drive gear through said first inlet, and said second source of fluid being delivered to an inlet of said driven gear through said second inlet.

10. A dual-inlet gear pump as set forth in claim 9, wherein consecutive teeth of said driven gear sealing on a housing surface as said teeth approach a port for communicating with said second inlet, said surface being sufficiently long such that adjacent ones of said teeth seal on said surface for at least a period of time as they approach said port.

* * * * *